US011581645B2

(12) United States Patent
Cheng et al.

(10) Patent No.: US 11,581,645 B2
(45) Date of Patent: Feb. 14, 2023

(54) MICROSTRIP ULTRA-WIDEBAND ANTENNA

(71) Applicant: Hangzhou Dianzi University, Hangzhou (CN)

(72) Inventors: Zhiqun Cheng, Hangzhou (CN); Zhen Wang, Hangzhou (CN); Ruoyu He, Hangzhou (CN); Peng Gao, Hangzhou (CN)

(73) Assignee: HANGZHOU DIANZI UNIVERSITY, Zhejiang (CN)

( * ) Notice: Subject to any disclaimer, the term of this patent is extended or adjusted under 35 U.S.C. 154(b) by 0 days.

(21) Appl. No.: 17/381,802

(22) Filed: Jul. 21, 2021

(65) Prior Publication Data

US 2022/0149523 A1 May 12, 2022

(30) Foreign Application Priority Data

Nov. 6, 2020 (CN) ..... 202011229627.6

(51) Int. Cl.
*H01Q 5/25* (2015.01)
*H01Q 7/00* (2006.01)
(Continued)

(52) U.S. Cl.
CPC ..... *H01Q 5/25* (2015.01); *H01Q 1/38* (2013.01); *H01Q 1/521* (2013.01); *H01Q 7/00* (2013.01); *H01Q 9/045* (2013.01)

(58) Field of Classification Search
CPC ..... H01Q 7/00; H01Q 5/25; H01Q 9/045; H01Q 1/523; H01Q 1/38; H01Q 1/48;
(Continued)

(56) References Cited

U.S. PATENT DOCUMENTS 9,431,715 B1 * 8/2016 Bhattacharyya ..... H01Q 13/025
2010/0271280 A1 * 10/2010 Pickles ..... H01Q 9/16 343/858

FOREIGN PATENT DOCUMENTS

CN 107591623 B * 1/2020
CN 109216936 B * 11/2020 ..... H01Q 1/38

OTHER PUBLICATIONS

He et al, "A 1×8 Linear Ultra-Wideband Phased Array With Connected Dipoles and Hyperbolic Microstrip Baluns", Published Sep. 2018, IEEE Access (Year: 2018).*
(Continued)

*Primary Examiner* — Ab Salam Alkassim, Jr.
*Assistant Examiner* — Anh N Ho
(74) *Attorney, Agent, or Firm* — M&B IP Analysts, LLC

(57) ABSTRACT

A microstrip ultra-wideband antenna is provided, including: an upper dielectric substrate, a radiation patch, an open-circuit line, a short-circuit line, a ground plane, a lower dielectric substrate, a vertical dielectric substrate, isolation walls, a hyperbolic microstrip balun feeder and an ideal wave port. The radiation patch is attached to a lower surface of the upper dielectric substrate; the ground plane is attached to an upper surface of the lower dielectric substrate; the short-circuit line and the open-circuit line are attached to a rear surface and a front surface of the vertical dielectric substrate respectively; the hyperbolic microstrip balun feeder is attached to the front and rear surface of the vertical dielectric substrate; the isolation walls are located between the upper dielectric substrate and the lower dielectric substrate perpendicularly to an end of the radiation patch; and the ideal wave port is provided below the hyperbolic microstrip balun feeder.

7 Claims, 12 Drawing Sheets

(51) Int. Cl.
*H01Q 9/04* (2006.01)
*H01Q 1/38* (2006.01)
*H01Q 1/52* (2006.01)

(58) Field of Classification Search
CPC ..... H01Q 1/50; H01Q 1/521; H01Q 5/10; H01Q 5/335
See application file for complete search history.

(56) References Cited

OTHER PUBLICATIONS

Gou et al., "A Compact Dual-Polarized Printed Dipole Antenna With High Isolation for Wideband Base Station Applications", IEEE, vol. 62, No. 8, Aug. 2014, p. 4392-4395 (Year: 2014).*
Desai et al, "A Broadband Printed Conical Bowtie Dipole Antenna with an Integrated Balun," 2019 United States National Committee of URSI National Radio Science Meeting (USNC-URSI NRSM), 2019, pp. 1-2, doi: 10.23919/USNC-URSI-NRSM.2019.8713028. (Year: 2019).*

* cited by examiner

MICROSTRIP ULTRA-WIDEBAND ANTENNA

CROSS REFERENCE TO RELATED APPLICATION

This patent application claims the benefit and priority of Chinese Patent Application No. 202011229627.6, entitled "MICROSTRIP ULTRA-WIDEBAND ANTENNA" filed on Nov. 6, 2020, which is incorporated herein by reference in its entirety as part of the present application.

TECHNICAL FIELD

The present disclosure relates to a technical field of an antenna, in particular to a microstrip ultra-wideband antenna.

BACKGROUND

With a continuous development of science and a continuous improvement and development of electronic communication systems, new requirements have been proposed on transmission capabilities of antennas. Researches on antennas with a wide bandwidth, wide-angle scanning, and good polarization performance have become current hot spot. Microstrip antennas have been widely used in modern communications due to the advantages of simple structure, light weight, miniaturization, wide bandwidth and easy connection to a microstrip feeder network. In recent years, with the popularization of wireless communication products and the development of ultra-wideband technology, an increasingly high requirement for the bandwidth of antennas is made. Ultra-wideband communication systems with a high data transmission rate, low cost, low power consumption and strong anti-interference ability have been developed rapidly since the Federal Communications Commission adopted a resolution to allow commercial application of 3.1 GHz to 10.6 GHz bands in 2002. An ultra-wideband antenna requires an appropriate impedance matching bandwidth. The miniaturization of antennas is critical to the development of the entire ultra-wideband antenna field, especially for communication systems, and is also a development trend. According to a traditional method for designing a broadband phased array, array elements with broadband characteristics are designed in isolation and then placed to an array. Due to the mutual coupling between the array elements, the elements usually change greatly after being placed to the array. Therefore, new methods for designing an ultra-wideband phased array have been studied by many researchers. The continuous increase in the number of independent antennas required by modern satellites has led to higher requirements for the size and volume of phased array antennas, so that many researchers face a challenge against demanding requirements.

A traditional method for designing an ultra-wideband antenna is used to design elements (such as a log-periodic antenna and a helical antenna) with broadband characteristics, each single element of which usually has a wide bandwidth, and then construct the elements into an array, measures such as mutual coupling reduction or mutual coupling compensation are used to minimize deterioration of radiation patterns of the elements. However, this method has two major difficulties in the design process as follows: firstly, as a scanning angle increases, there is a strong mutual coupling effect between the elements, so that the performance of the entire antenna is much lower than that of a single element; and secondly, the designed antenna is bulky and needs to be covered with a radome on the outside of the antenna to meet shape requirements by a vehicle. In terms of the wide scanning angle, most traditional ultra-wideband antennas use a metal rod to remove scanning blind spots, but the blind spots are not completely removed in a desired band.

A major feature of an ultra-wideband antenna is the wide bandwidth. The wide bandwidth can increase an impedance span, resulting in higher frequency problems one after another. An impedance matching method for narrowband antennas cannot solve the problems of the ultra-wideband antennas. Researchers have developed a series of impedance matching methods for ultra-wideband antennas, but some methods have high requirements for processing.

Vivaldi arrays are a good option that meets the above requirements. However, elements of a Vivaldi array are a 3-dimensional high-profile structure rather than a planar structure. To address the above two issues, researchers have proposed some methods, such as increasing spacing between antenna elements to reduce mutual coupling. However, to prevent grating lobes at high frequencies, the spacing between the elements cannot exceed one wavelength, which limits broadening of the spacing between the antenna elements. The gain of the array antenna decreases quickly due to a strong mutual coupling effect at low frequencies, and thus antenna designers have begun to explore new design methods for ultra-wideband antennas. At present there are two mainstream methods: a tightly coupled dipole ultra-wideband array antenna and a linked-arm ultra-wideband array antenna.

SUMMARY

In view of the foregoing defects, the present disclosure provides a method for blind spot scanning and impedance matching of an ultra-wideband array antenna, according to which all scanning blind spots of the array antenna are removed through isolation walls, thereby achieving an ultra-wideband array antenna without blind spots, and a hyperbolic microstrip balun is connected in parallel to a short-circuit line and then connected in series to an open-circuit line, thereby implementing impedance matching without addition of other media, and thus the antenna is miniaturized and has a wide bandwidth.

To achieve the above effect, the present disclosure provides a method for blind spot scanning and impedance matching of a microstrip ultra-wideband antenna. Firstly, a distance between a hyperbolic microstrip balun and an adjacent radiation unit is increased by using the isolation walls, so that blind spots in a band are removed out of the band and thus a problem of scanning blind spots is solved. Secondly, impedance matching is implemented by adjusting an impedance in a wide band of the ultra-wideband antenna to be a value required by the antenna.

To achieve this effect, the antenna is connected in parallel to the short-circuit line to reduce a reactance value in the band. Then, the antenna is connected in series to the open-circuit line to further reduce the reactance value in the band. Finally, the hyperbolic microstrip balun is used to match a resistance. The above hyperbolic microstrip balun has a special feature, that is, it can be used as a balance-nonbalance converter. A technical solution of the present disclosure is as follows:

A microstrip ultra-wideband antenna is provided, including an upper dielectric substrate, a radiation patch, an open-circuit line, a short-circuit line, a ground plane, a lower dielectric substrate, a vertical dielectric substrate, isolation walls, a hyperbolic microstrip balun feeder, and an ideal wave port, wherein the radiation patch is attached to a lower surface of the upper dielectric substrate; the ground plane is attached to an upper surface of the lower dielectric substrate; the short-circuit line is attached to a rear surface of the vertical dielectric substrate; the open-circuit line is attached to a front surface of the vertical dielectric substrate; the hyperbolic microstrip balun feeder is attached to the front surface and the rear surface of the vertical dielectric substrate; the isolation walls are located between the upper dielectric substrate and the lower dielectric substrate perpendicularly to an end of the radiation patch; and the ideal wave port is provided below the hyperbolic microstrip balun feeder.

In an embodiment, the radiation patches are provided in pairs, and are thin sheets of metal material, and two outer ends of a pair of radiation patches are connected to upper ends of the isolation walls.

In an embodiment, the isolation walls are thin sheets of metal material.

In an embodiment, the ground plane is a thin sheet of metal material, and the isolation walls are connected to an upper surface of the ground plane, and then connected to the radiation patches to form a loop structure.

In an embodiment, the short-circuit line is a thin sheet of metal material, an upper end of the short-circuit line is connected to the radiation patch, and a lower end of the short-circuit line is connected to an upper surface of the ground plane.

In an embodiment, the open-circuit line is a thin sheet of metal material, and is connected to an upper end of a balanced end of the hyperbolic microstrip balun feeder.

In an embodiment, the hyperbolic microstrip balun feeder is a thin sheet of metal material, and an upper part of an unbalanced end of the hyperbolic microstrip balun feeder is connected to the radiation patch.

In an embodiment, the open-circuit line is attached to the front surface of the vertical dielectric substrate, and the short-circuit line serves as a radiation ground of the open-circuit line.

Compared with the conventional art, the present disclosure firstly realizes a wide scanning angle. A problem of scanning blind spots is solved by using the isolation walls. Table 1 shows comparison results in the cases of with and without isolation walls, which clearly shows that blind spots have been removed out of an effective band. Secondly with respect to impedance matching of the antenna, the antenna is connected in parallel to the short-circuit line, thereby reducing the reactance value in the effective band, and then connected in series to the open-circuit line, thereby further optimizing the reactance value in the effective band and making the resistance value smaller in the effective band, and an ideal impedance is achieved by taking the feature of the hyperbolic microstrip balun. The present disclosure also achieves miniaturization of the antenna. During impedance matching, the short-circuit line, the open-circuit line, and the hyperbolic microstrip balun share one dielectric substrate, reducing the use of dielectric substrates. The open-circuit line uses the short-circuit line as a radiation ground, reducing the use of a metal ground, which makes the antenna more miniaturized.

DETAILED DESCRIPTION OF THE EMBODIMENTS

To make the intentions, technical solutions, and advantages of the present disclosure clearer, the following further describes the present disclosure in detail with reference to the accompanying drawings and embodiments. It should be understood that the specific embodiments described herein are merely intended to illustrate the present disclosure and are not intended to limit the present disclosure.

Instead, the present disclosure covers any substitutions, modifications, equivalent methods and solutions defined by the claims in the spirit and scope of the present disclosure. Further, for better understanding of the present disclosure, some specific details are described in detail in the following detailed description of the present disclosure. Those skilled in the art can fully understand the present disclosure without the description of these details.

Figure 1:
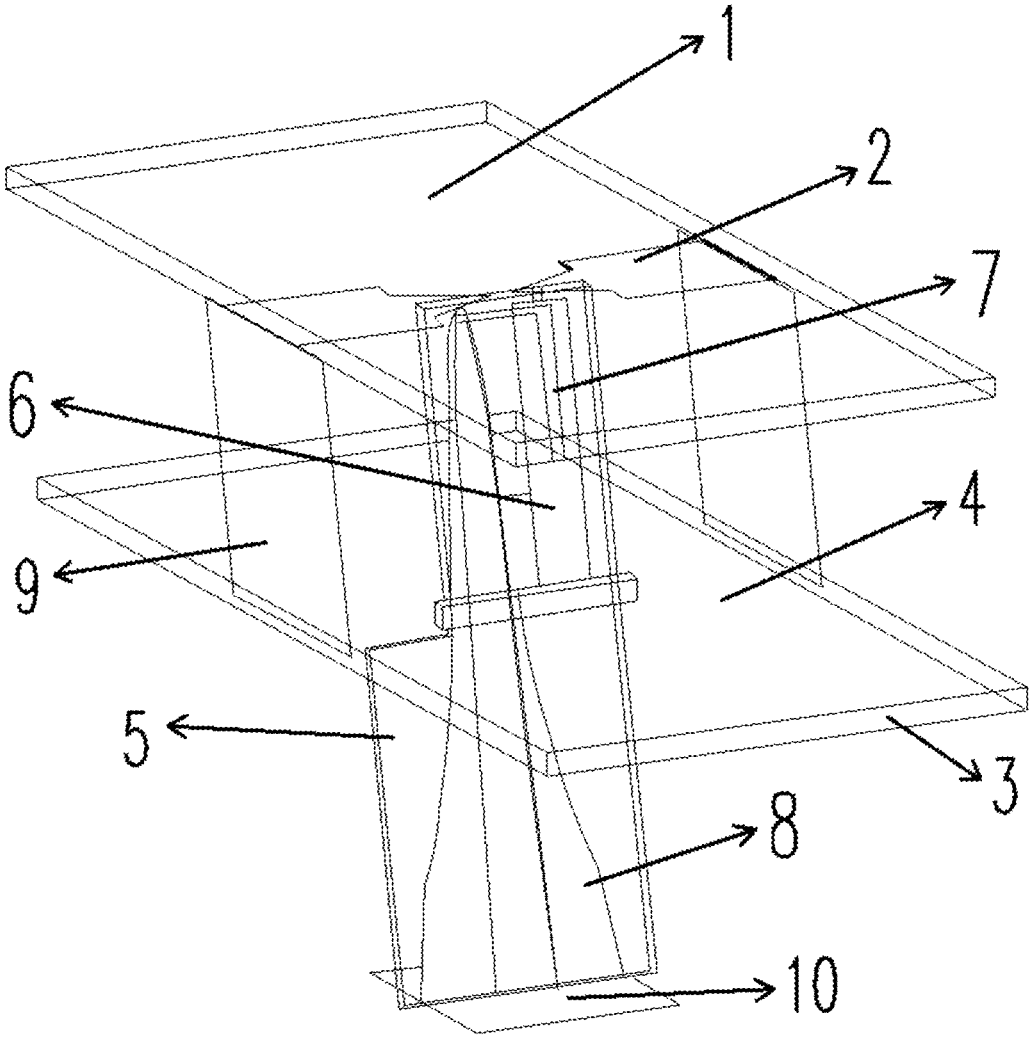
FIG. 1 is a schematic structural diagram of a microstrip ultra-wideband antenna according to an embodiment of the present disclosure.
Figure 2:
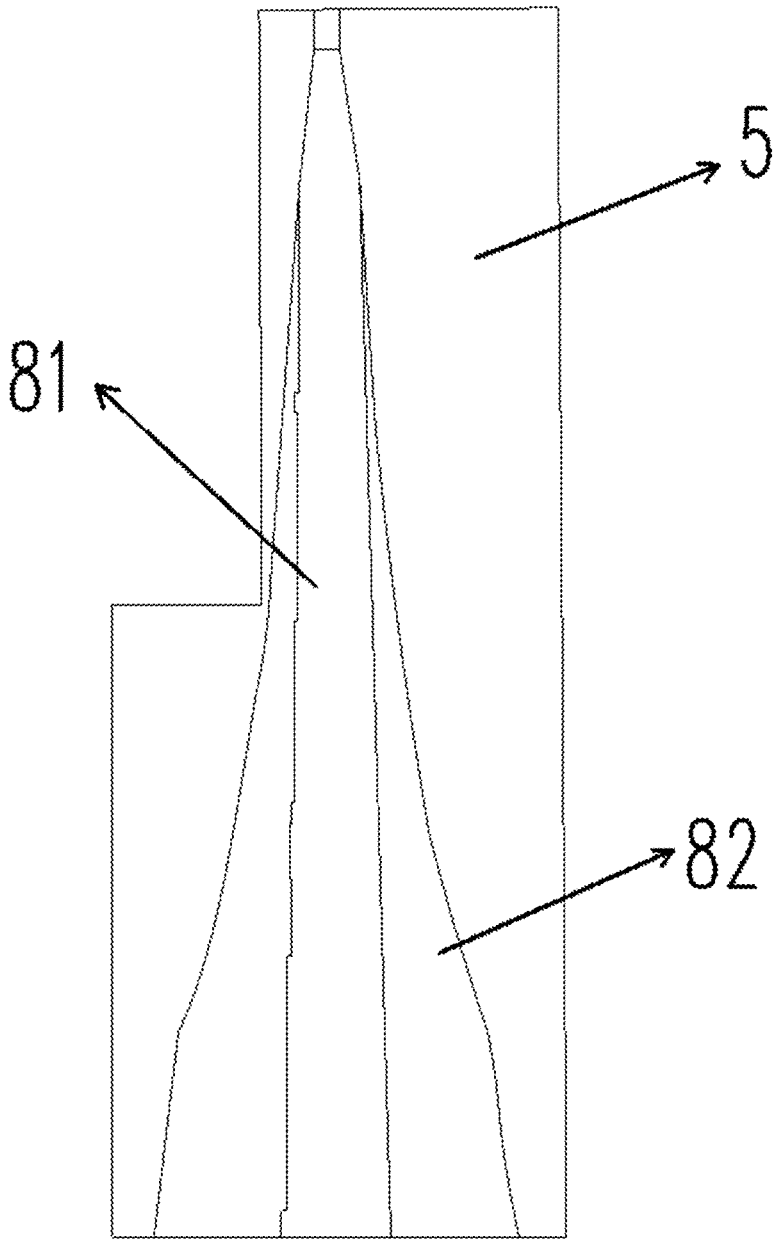
FIG. 2 is a schematic structural diagram of a hyperbolic microstrip balun feeder of a microstrip ultra-wideband antenna according to an embodiment of the present disclosure.

FIG. 1 is a schematic structural diagram of a microstrip ultra-wideband antenna according to an embodiment of the present disclosure. FIG. 2 is a schematic structural diagram of a hyperbolic microstrip balun feeder. A microstrip ultra-wideband antenna includes an upper dielectric substrate 1, a radiation patch 2, an open-circuit line 7, a short-circuit line 6, a ground plane 4, a lower dielectric substrate 3, a vertical dielectric substrate 5, isolation walls 9, a hyperbolic microstrip balun feeder 8, and an ideal wave port 10.

The radiation patch 2 is attached to a lower surface of the upper dielectric substrate 1; the ground plane 4 is attached to an upper surface of the lower dielectric substrate 3; the short-circuit line 6 is attached to a rear surface of the vertical dielectric substrate 5; the open-circuit line 7 is attached to a front surface of the vertical dielectric substrate 5; the hyperbolic microstrip balun feeder 8 is attached to the front surface and the rear surface of the vertical dielectric substrate 5; the isolation walls 9 are located between the upper dielectric substrate 1 and the lower dielectric substrate 3 perpendicularly to an end of the radiation patch 2; and the ideal wave port 10 is provided below the hyperbolic microstrip balun feeder 8.

Figure 3:
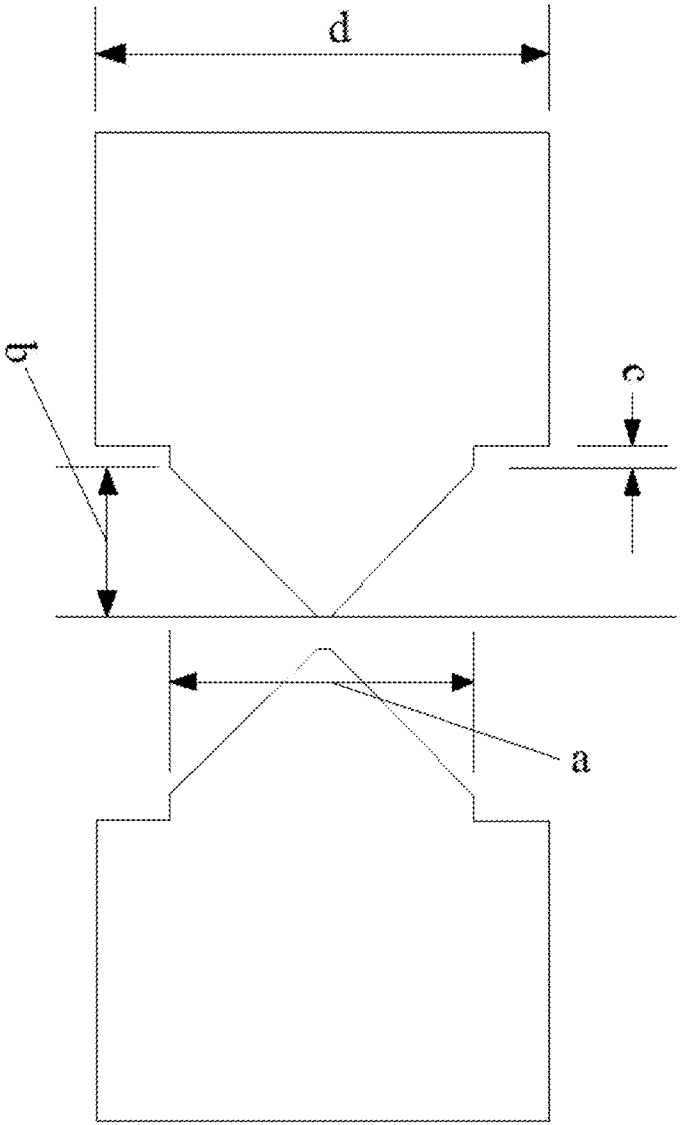
FIG. 3 is a schematic diagram of a shape of radiation patches of a microstrip ultra-wideband antenna according to an embodiment of the present disclosure.

FIG. 3 is a schematic diagram of a shape of the radiation patches 2. The radiation patches 2 are provided in pairs, and are thin sheets of metal material, and two outer ends of a pair of radiation patches 2 are connected to upper ends of the isolation walls 9. Specifically, a=7 mm, b=3.4 mm, c=0.05 mm, and d=12.5 mm.

The isolation walls 9 are a thin sheet of metal material; the ground plane 4 is a thin sheet of metal material, and the isolation walls 9 are connected to the upper surface of the ground plane 4, and then connected to the radiation patches 2 to form a loop structure; the short-circuit line 6 is a thin sheet of metal material, an upper end of the short-circuit line 6 is connected to the radiation patch 2, and a lower end of the short-circuit line 6 is connected to the ground plane 4; the open-circuit line 7 is a thin sheet of metal material, and is connected to an upper end of a balanced end 81 of the hyperbolic microstrip balun feeder 8; the hyperbolic microstrip balun feeder 8 is a thin metal material, and an upper part of an unbalanced end 82 of the hyperbolic microstrip balun feeder 8 is connected to the radiation patch 2; and the open-circuit line 7 is attached to the front surface of the vertical dielectric substrate 5, and the short-circuit line 6 serves as a radiation ground for the open-circuit line 7.

The entire impedance matching process intends to reduce a reactance value, thereby radiating more energy, and finally match a resistance value. The impedance matching of a microstrip ultra-wideband antenna includes four steps:

step 1: performing impedance simulation after the isolation walls 9 are placed between the radiation patches 2 and the ground plane 4;

step 2: further optimizing an impedance of the antenna considering that an impedance characteristic of the short-circuit line 6 between both ends of a center frequency is exactly opposite to that between both ends of a resonance frequency of the antenna;

step 3: further optimizing a reactance of the antenna considering that an impedance characteristic of the open-circuit line 7 between both ends of the center frequency is exactly opposite to that between both ends of the resonance frequency of the antenna; and step 4: continuously adjusting parameters of the hyperbolic microstrip balun based on a combination of an impedance characteristic of the balance-nonbalance hyperbolic microstrip balun with that of the antenna, to achieve an ideal antenna impedance finally.

Figure 4A:
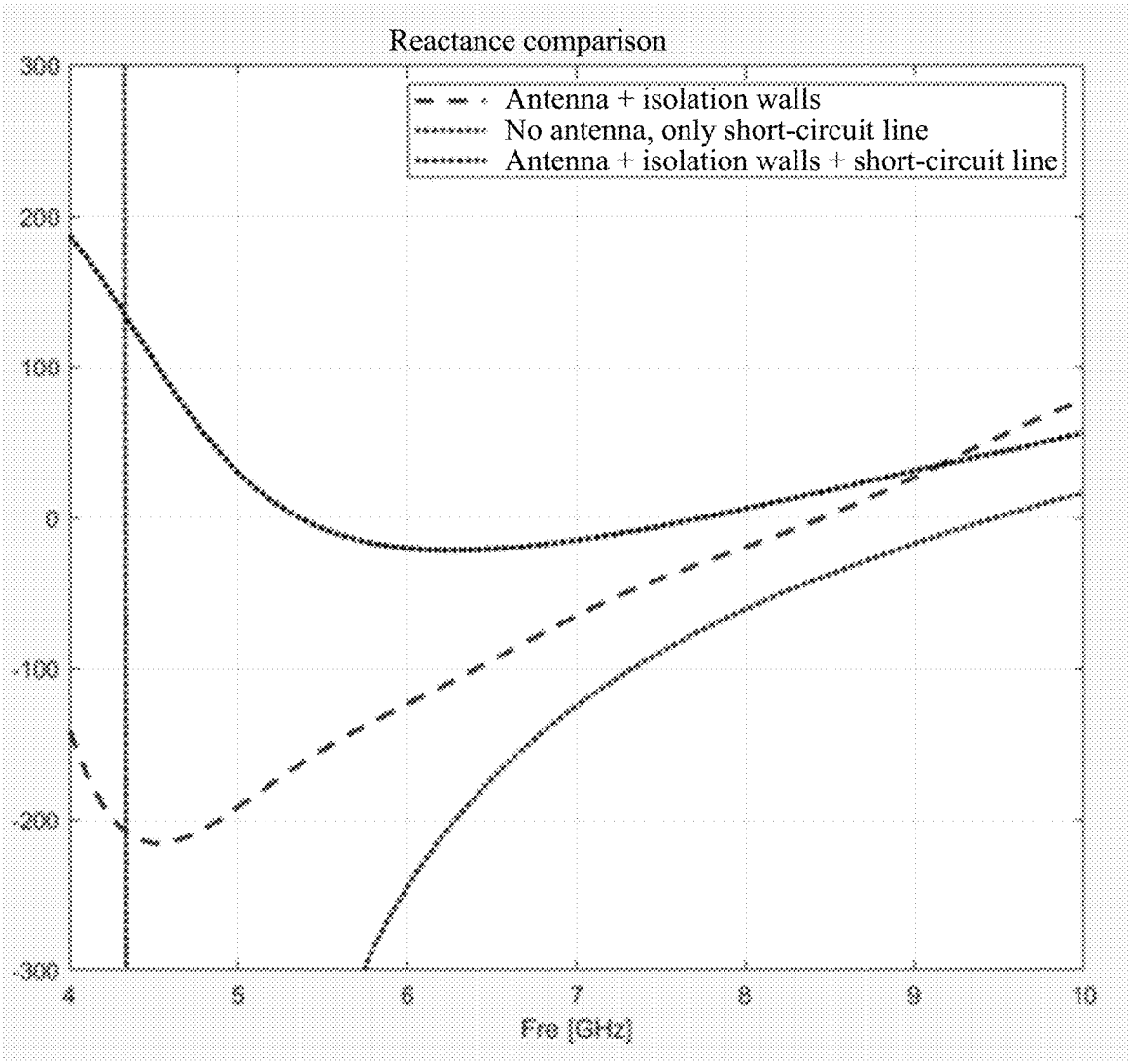
FIG. 4*a* and FIG. 4*b* are simulation result diagrams when an antenna of a microstrip ultra-wideband antenna is connected in parallel to a short-circuit line according to an embodiment of the present disclosure.
Figure 4B:
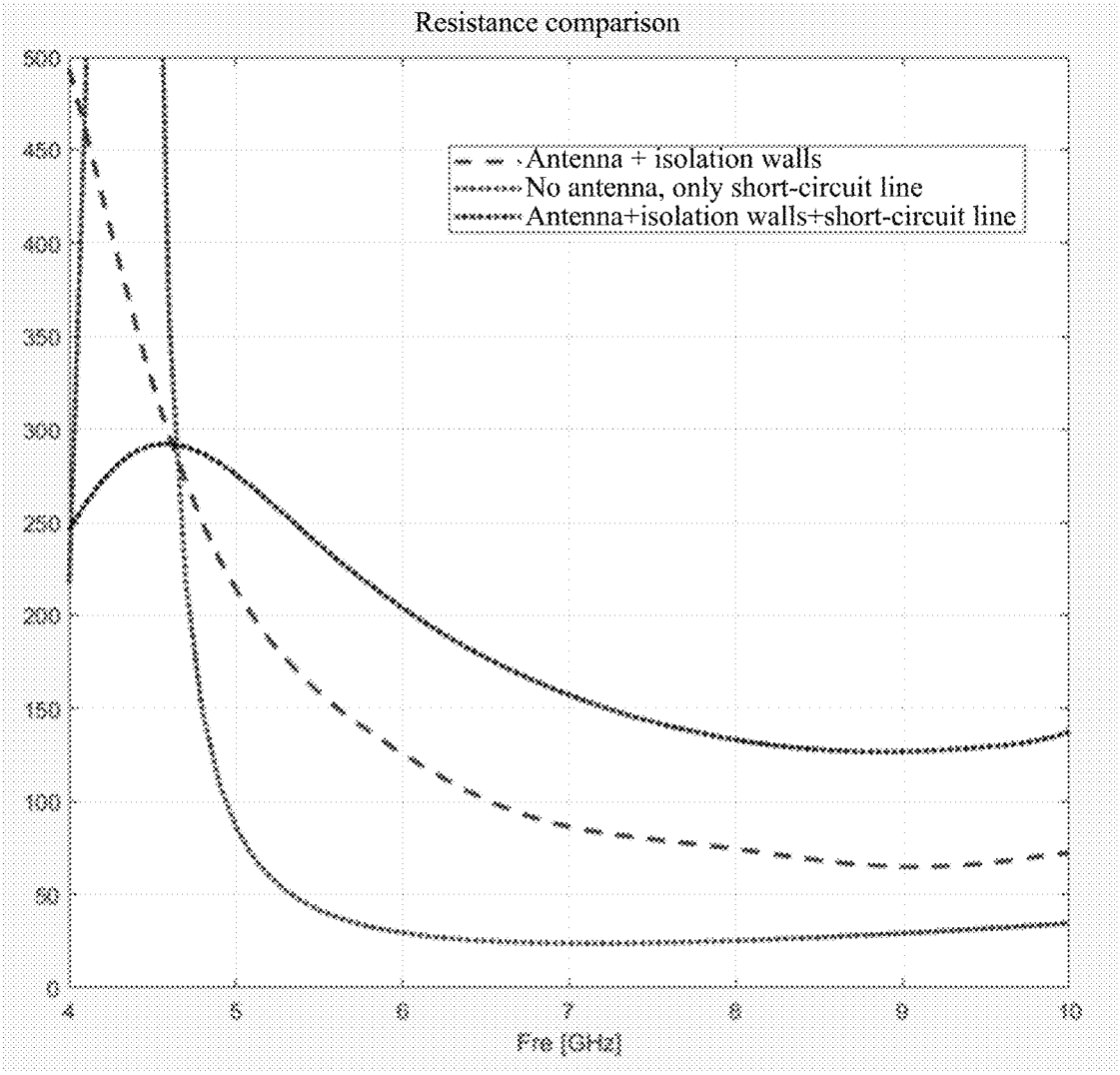

As shown in FIG. 4*a* and FIG. 4*b*, for the reactance of the antenna, there is only one resonant frequency at high frequencies when the isolation walls 9 are applied, but this resonant frequency does not fluctuate much. Therefore, the resonant frequency is set as a resonant frequency of the short-circuit line 6, and ¼ wavelength of the short-circuit line 6 can be calculated. Through continuous simulation, it is found that an actual resonant frequency of the short-circuit line 6 is higher than an assumed resonant frequency of the short-circuit line 6. After the isolation walls 9 and the actually used short-circuit line 6 are applied to the antenna, the resonant frequency moves to a low frequency.

Figure 5A:
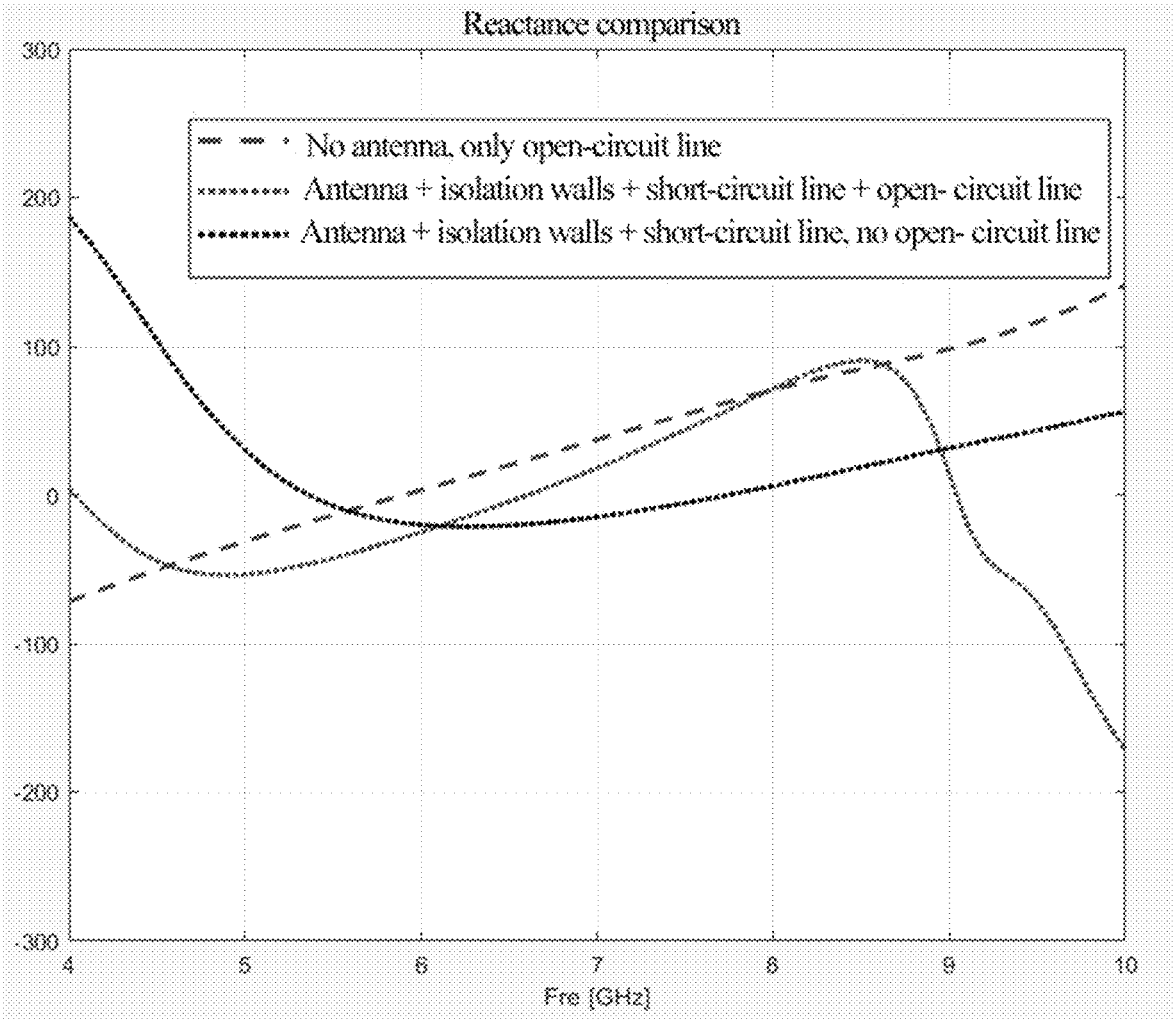
FIG. 5*a* and FIG. 5*b* are simulation result diagrams when an antenna of a microstrip ultra-wideband antenna is connected in parallel to a short-circuit line and then connected in series to an open-circuit line according to an embodiment of the present disclosure.
Figure 5B:
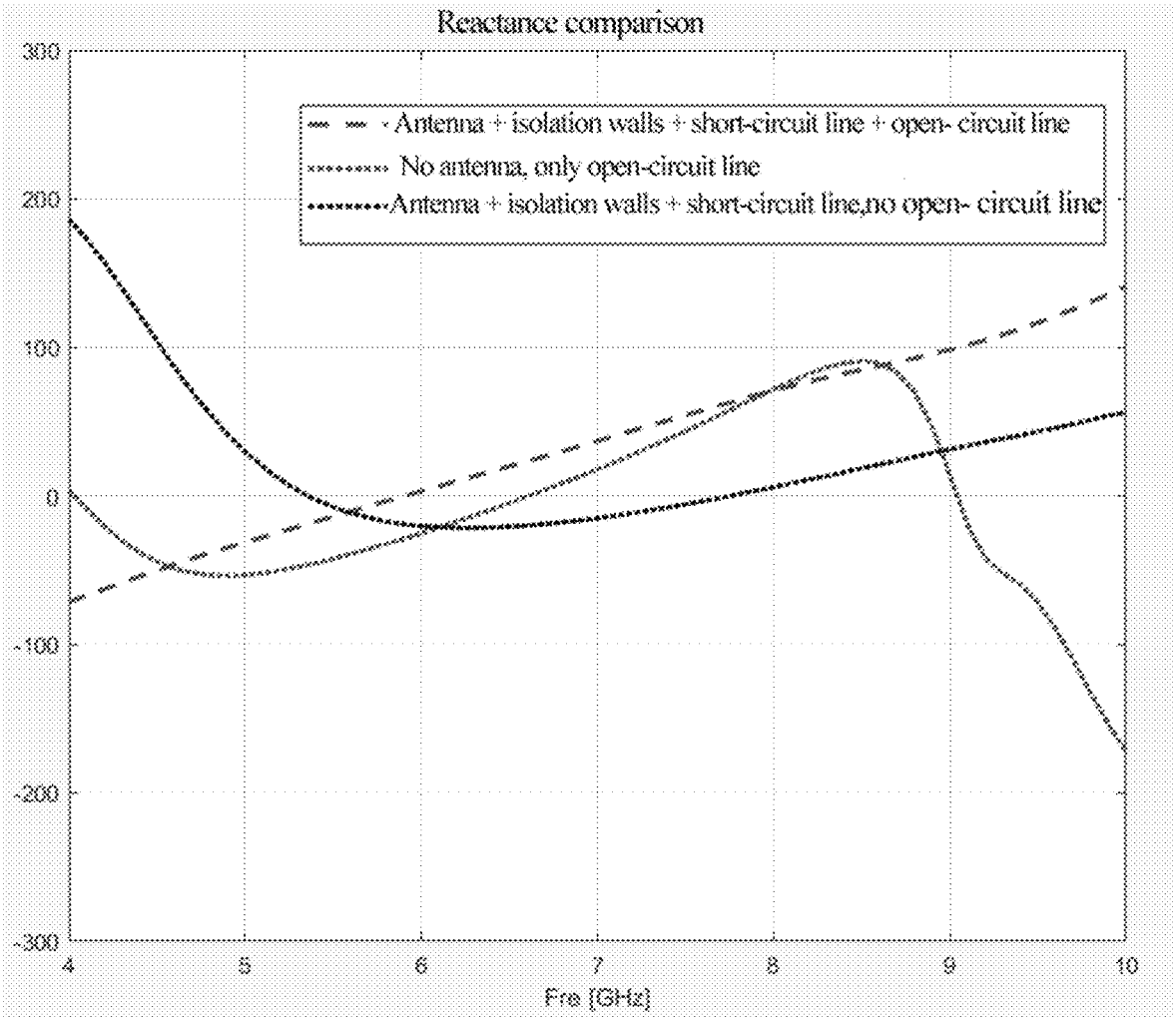

As shown in FIG. 5*a* and FIG. 5*b*, two resonant frequencies appear in the simulation result after the antenna is connected in parallel to the short-circuit line 6. When the frequency of the antenna is below the first resonant frequency, the antenna is inductive (with a value close to 200). When the frequency of the antenna is between the first resonant frequency and the second resonant frequency, the antenna is capacitive (with a value close to 20). In this case, the antenna is connected in series to the open-circuit line 7, so that the antenna shows a balance of inductance and capacitance around the first resonant frequency. First, it is assumed that the first resonant frequency is a resonant frequency of the open-circuit line 7, and then ¼ wavelength of the open-circuit line 7 can be calculated. Through continuous simulations, an actual length of the open-circuit line 7 used by the antenna is different from a theoretical value, and the inductance and capacitance of the antenna shown near the first resonant frequency are more balanced, which is conducive to the next impedance matching.

Figure 6A:
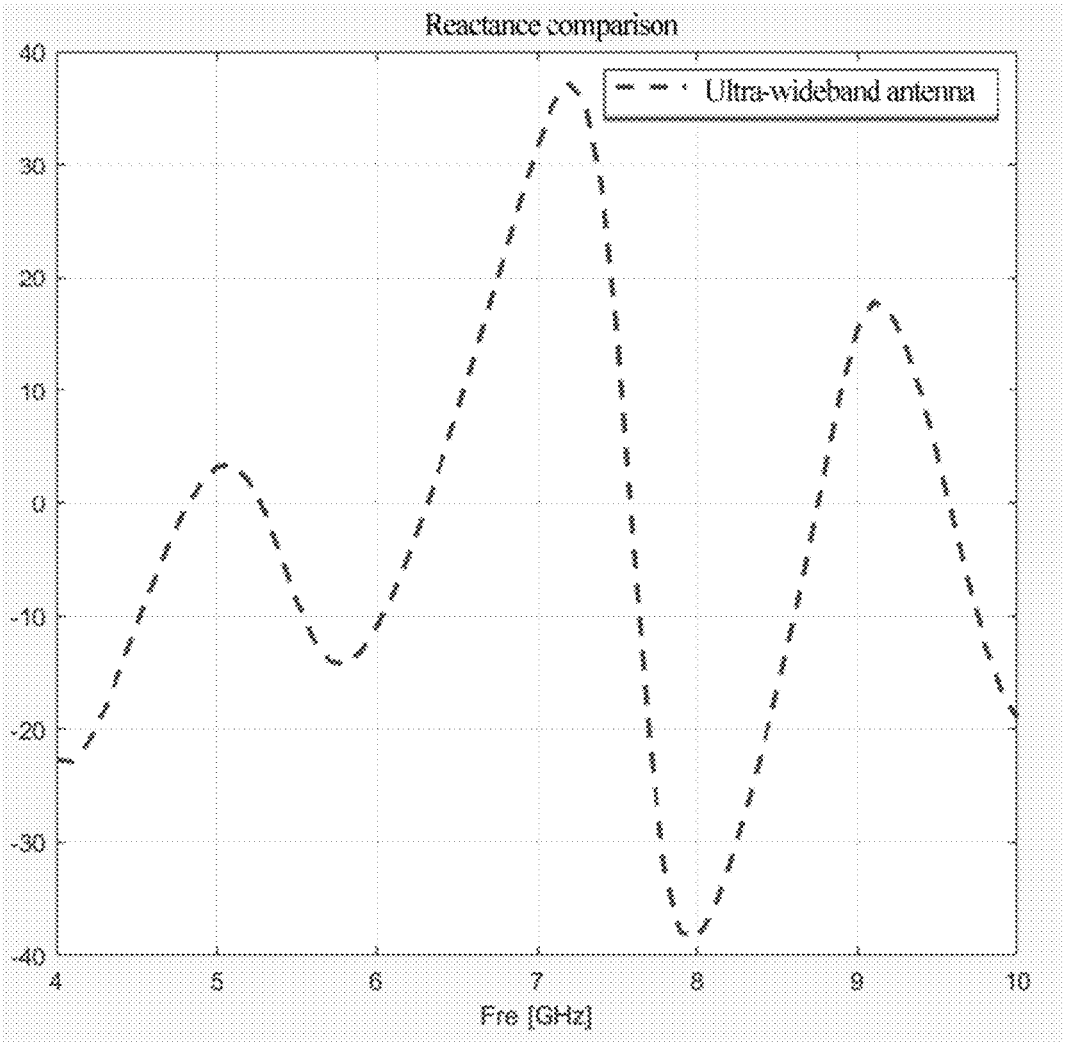
FIG. 6*a* and FIG. 6*b* are simulation result diagrams when an antenna of a microstrip ultra-wideband antenna is connected in parallel to a short-circuit line and then in series to an open-circuit line, and then a hyperbolic microstrip balun is applied according to an embodiment of the present disclosure.
Figure 6B:
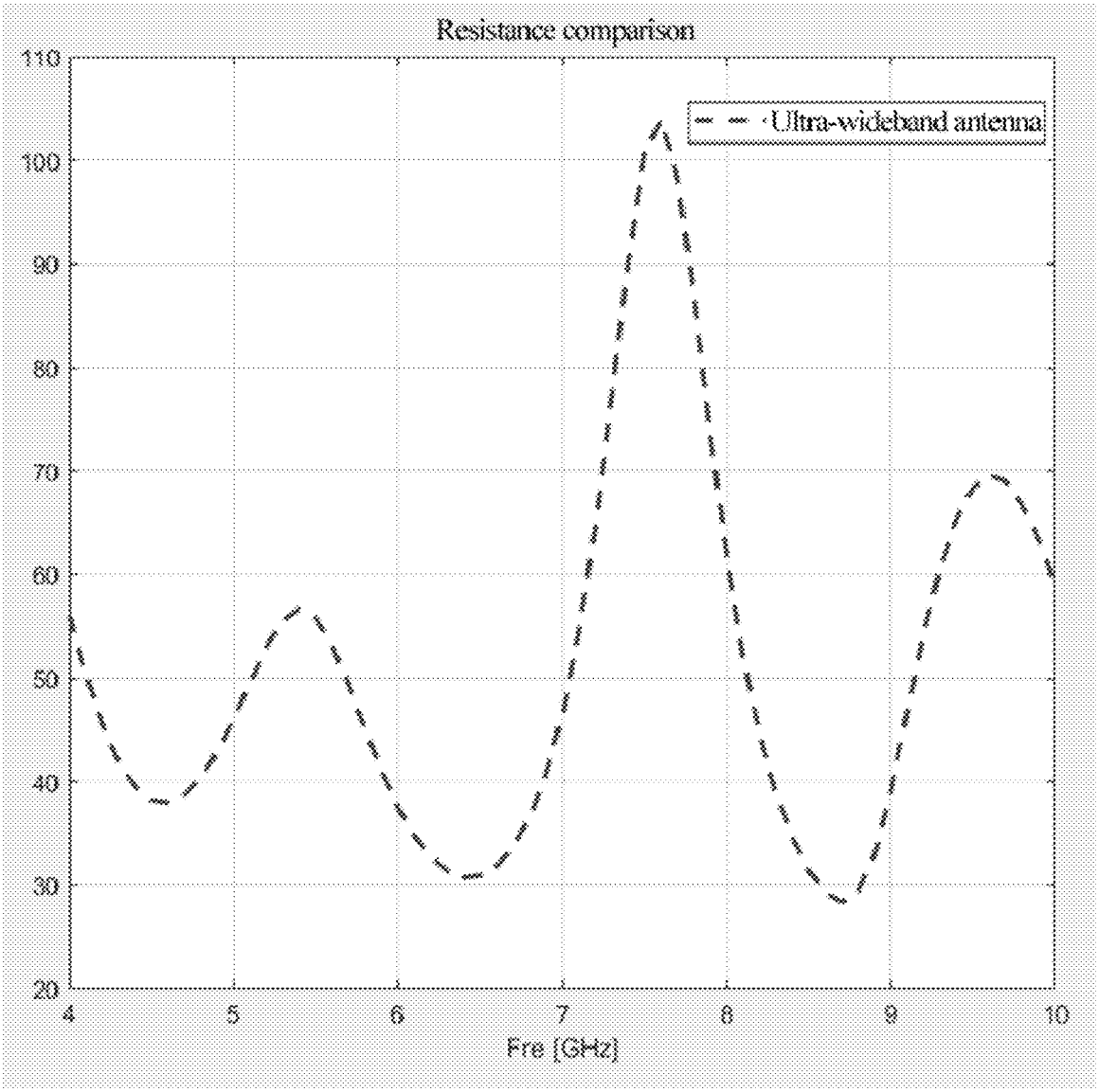

FIG. 6*a* and FIG. 6*b* show simulation results after the antenna is connected in parallel to the short-circuit line 6 and in series to the open-circuit line 7, and the hyperbolic microstrip balun is applied. FIG. 6 is also a schematic diagram of the impedance of the microstrip ultra-wideband antenna according to the present disclosure. The structure, size, and broadband range of the ultra-wideband antenna have been determined in this case. As shown in FIG. 6, after the hyperbolic microstrip balun is applied, the reactance value is matched to around 0, and the resistance value is matched to around 50 ohms, achieving an ideal situation within the entire bandwidth.

Figure 7:
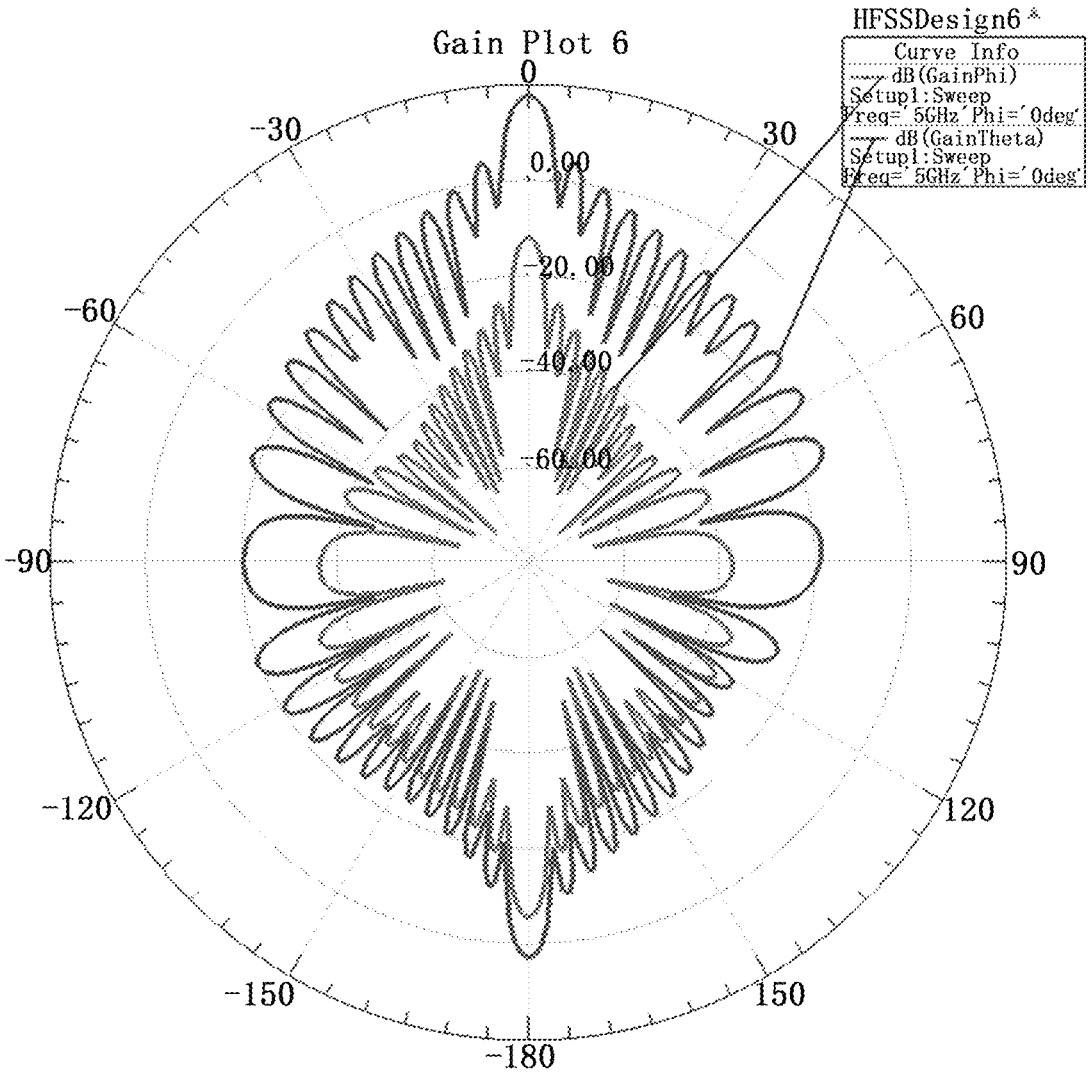
FIG. 7 is a radiation pattern of a microstrip ultra-wideband antenna at a frequency of 5 GHz according to an embodiment of the present disclosure.
Figure 8:
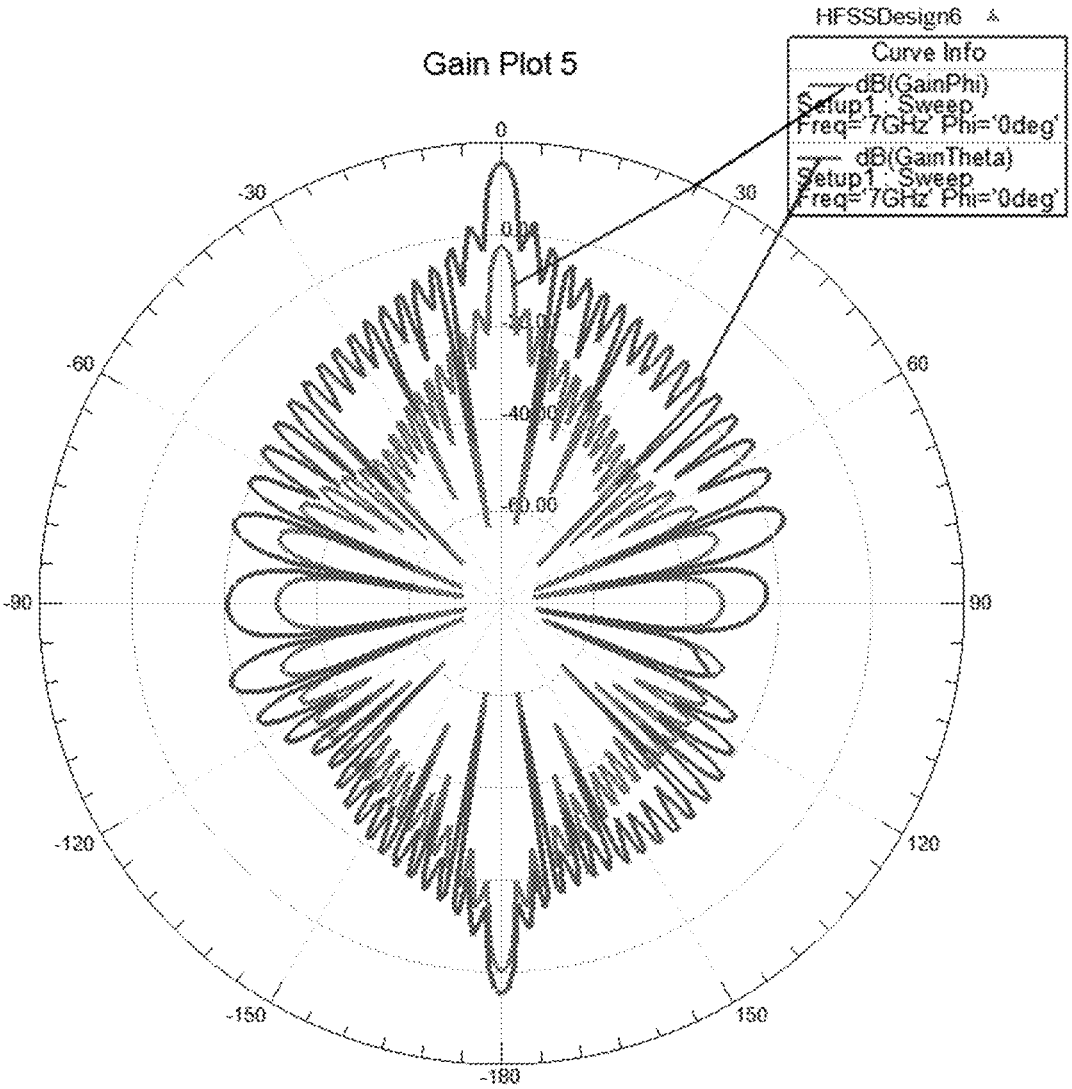
FIG. 8 is a radiation pattern of a microstrip ultra-wideband antenna at a frequency of 7 GHz according to an embodiment of the present disclosure.

FIG. 7 and FIG. 8 are radiation patterns of the antenna at frequencies of 5 GHz and 7 GHz. The radiation pattern of the antenna is an important diagram used to measure performance of the antenna, and some parameters of the antenna can be observed from the radiation pattern. As shown in FIG. 7 and FIG. 8, there is no large distortion in the far field, indicating that the performance of the antenna is still good and a matching circuit has implemented a balance-nonbalance conversion.

Figure 9:
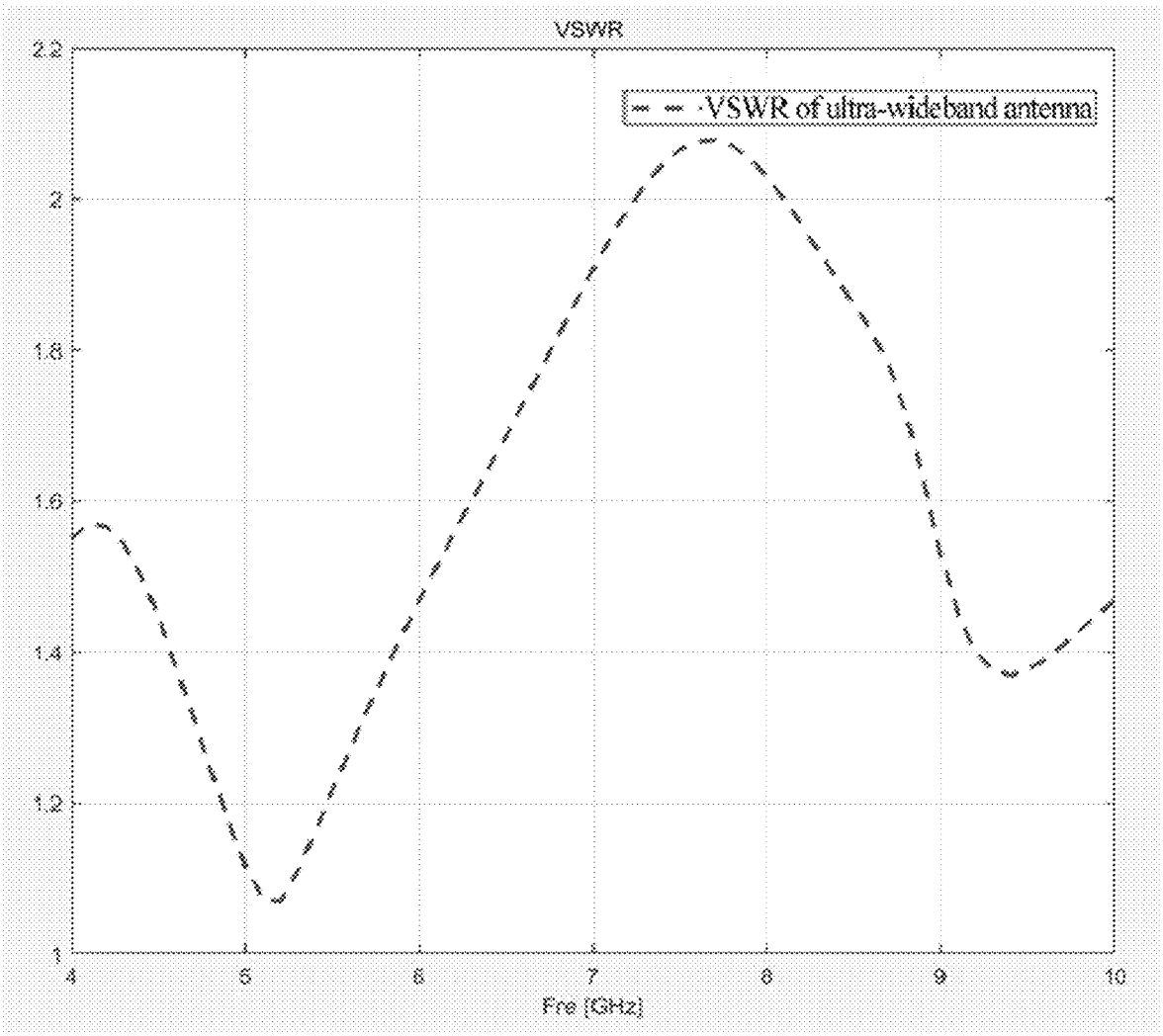
FIG. 9 is a schematic diagram of a voltage standing wave ratio (VSWR) of a microstrip ultra-wideband antenna according to an embodiment of the present disclosure.

FIG. 9 shows a VSWR of the antenna. The VSWR is also an important parameter to measure the performance of the antenna. The closer the value of the VSWR to 1, the more desirable. Herein, the VSWR is an important indicator to measure the quality of impedance matching. As shown in FIG. 9, the VSWR is less than 2.1, and the VSWR is greater than 2 and less than 2.1 only in a band of 7.3 GHz to 8.1 GHz. Most ideally, the VSWR of the antenna is less than 2. Therefore, the antenna according to the present disclosure can basically meet the antenna requirements.

Table 1 shows the comparison of scanning blind spots of the antenna with and without the isolation walls 9. According to Table 1, after the isolation walls 9 are applied, all scanning blind spots are removed out of the band, achieving a wider scanning angle in the band and a better performance.

TABLE 1

Scanning blind spots at different angles on plane E

| Scanning angle | Blind spot (with metal walls) | Grating lobe | Blind spot (without metal walls) |
|---|---|---|---|
| 0° | none | none | none |
| 15° | none | 10.0 GHz | none |
| −15° | none | 10.0 GHz | none |
| 30° | none | 8.6 GHz | 4.2 GHz |
| −30° | none | 8.6 GHz | none |
| 45° | none | 7.7 GHz | 4.9 GHz |
| −45° | none | 7.7 GHz | 4.9 GHz |
| 60° | none | 7.0 GHz | 6.0 GHz |
| −60° | none | 7.0 GHz | 5.9 GHz |

The above descriptions are merely preferred embodiments of the present disclosure, and are not intended to limit the present disclosure. Any modification, equivalent substitution and improvement without departing from the spirit and principle of the present disclosure shall be included within the scope of the present disclosure.

What is claimed is:

1. A microstrip ultra-wideband antenna, comprising:

an upper dielectric substrate, a radiation patch, an open-circuit line, a short-circuit line, a ground plane, a lower dielectric substrate, a vertical dielectric substrate, isolation walls, a hyperbolic microstrip balun feeder and an ideal wave port, wherein, the radiation patch is attached to a lower surface of the upper dielectric substrate; the ground plane is attached to an upper surface of the lower dielectric substrate; the short-circuit line is attached to a rear surface of the vertical dielectric substrate; the open-circuit line is attached to a front surface of the vertical dielectric substrate; the hyperbolic microstrip balun feeder is attached to the front surface and the rear surface of the vertical dielectric substrate; the isolation walls are located between the upper dielectric substrate and the lower dielectric substrate perpendicularly to an end of the radiation patch; and the ideal wave port is provided below the hyperbolic microstrip balun feeder; and the radiation patches are provided in pairs, and are thin sheets of metal material, and two outer ends of a pair of radiation patches are connected to upper ends of the isolation walls.

2. The microstrip ultra-wideband antenna according to claim 1, wherein the isolation walls are thin sheets of metal material.

3. The microstrip ultra-wideband antenna according to claim 1, wherein the ground plane is a thin sheet of metal material, and the isolation walls are connected to an upper surface of the ground plane, and then connected to the radiation patches to form a loop structure.

4. The microstrip ultra-wideband antenna according to claim 1, wherein the short-circuit line is a thin sheet of metal material, an upper end of the short-circuit line is connected to the radiation patch, and a lower end of the short-circuit line is connected to the ground plane.

5. The microstrip ultra-wideband antenna according to claim 1, wherein the open-circuit line is a thin sheet of metal material, and is connected to an upper end of a balanced end of the hyperbolic microstrip balun feeder.

6. The microstrip ultra-wideband antenna according to claim 1, wherein the hyperbolic microstrip balun feeder is a thin sheet of metal material, and an upper part of an unbalanced end of the hyperbolic microstrip balun feeder is connected to the radiation patch.

7. The microstrip ultra-wideband antenna according to claim 1, wherein the open-circuit line is attached to the front surface of the vertical dielectric substrate, and the short-circuit line serves as a radiation ground of the open-circuit line.

* * * * *